US007517286B2

(12) United States Patent
Nagai et al.

(10) Patent No.: US 7,517,286 B2
(45) Date of Patent: Apr. 14, 2009

(54) TRIAL GOLF CLUB FOR MEASURING LOFT ANGLE AND METHODS FOR USING THE SAME

(75) Inventors: Masao Nagai, Suwanee, GA (US); Chris Voshall, Atlanta, GA (US); Bill Price, Roswell, GA (US); David Llewellyn, Duluth, GA (US); Richard Delvac, Lawrenceville, GA (US)

(73) Assignee: Mizuno USA, Norcross, GA (US)

( * ) Notice: Subject to any disclaimer, the term of this patent is extended or adjusted under 35 U.S.C. 154(b) by 0 days.

(21) Appl. No.: 11/539,307

(22) Filed: Oct. 6, 2006

(65) Prior Publication Data

US 2008/0085779 A1 Apr. 10, 2008

(51) Int. Cl.
*A63B 53/06* (2006.01)

(52) U.S. Cl. ..... 473/245; 473/325; 473/409

(58) Field of Classification Search ..... 473/282, 473/328, 324, 219, 226, 409, 278, 325, 231
See application file for complete search history.

(56) References Cited

U.S. PATENT DOCUMENTS

| | | | | | |
|---|---|---|---|---|---|
| 4,754,974 | A * | 7/1988 | Kobayashi | 473/327 |
| 5,326,105 | A * | 7/1994 | Fenton, Jr. | 473/328 |
| 5,377,983 | A * | 1/1995 | Fenton | 473/328 |
| 5,429,353 | A * | 7/1995 | Hoeflich | 473/350 |
| 5,593,356 | A * | 1/1997 | Takeda | 473/335 |
| 5,603,668 | A * | 2/1997 | Antonious | 473/328 |
| D388,486 | S * | 12/1997 | Mahaffey | D21/748 |
| 5,863,259 | A | 1/1999 | Sacco | |
| 6,471,599 | B2 * | 10/2002 | Ford | 473/242 |
| 6,592,468 | B2 * | 7/2003 | Vincent et al. | 473/334 |
| 6,729,967 | B2 * | 5/2004 | Ford | 473/242 |
| 2002/0006834 | A1 * | 1/2002 | Toyota | 473/328 |
| 2003/0162607 | A1 * | 8/2003 | Tsunoda et al. | 473/324 |
| 2004/0023725 | A1 | 2/2004 | Llewellyn et al. | |

FOREIGN PATENT DOCUMENTS

JP 2003-220160 A * 8/2003

OTHER PUBLICATIONS

International Search Report & Written Opinion for related PCT Application No. PCT/US2007/021499 dated May 6, 2008.

* cited by examiner

*Primary Examiner*—Stephen L. Blau
(74) *Attorney, Agent, or Firm*—Troutman Sanders LLP; James E. Schutz; Filip A. Kowalewski

(57) ABSTRACT

The invention is directed toward a trial golf club head and method for determining the optimal loft angle for any golf club, and in particular a hybrid-type golf club. The invention includes a trial golf club head having a face portion, a leading edge portion, a toe portion, a heel portion, a back portion having a trailing edge portion, and a sole portion. The sole portion contains a number of equally spaced graduated indicia, which are substantially parallel to one another and extend from the toe portion to the heel portion. The distance between the graduated indicia is approximately 3.75 centimeters (cm), which corresponds to an incremental loft angle of approximately 3 degrees. The sole portion has a radius of curvature of 71.67 mm, which extends from the leading edge of the face portion to the trailing edge of the back portion.

11 Claims, 7 Drawing Sheets

TRIAL GOLF CLUB FOR MEASURING LOFT ANGLE AND METHODS FOR USING THE SAME

TECHNICAL DESCRIPTION OF THE INVENTION

The present invention is directed to a trial golf club head for a golf club fitting system, and more particularly to a trial golf club for determining the optimal loft of a golf club for use with a golf club fitting system.

BACKGROUND

Purchasing a new set of golf clubs is a major investment for many golfers. Therefore, any golfer who is about to invest in purchasing a new set of clubs typically takes the extra step to insure that their new golf clubs are custom fit rather than purchasing "off-the shelf golf clubs." "Off-the-shelf" golf clubs are one-size-fits-all, designed for a "typical" golfer. Normally an "average golfer" refers to someone who is approximately 5-foot-9 or 5-10 and hits a 5- or 6-iron about 160 yards. However, every golfer has a different body shape, and a different golf swing. A golfer might get lucky with an off-the-shelf set, but many golfers will find that such a set is ill-suited for their particular body and/or swing. As a result many golfers are opting for custom fitting session to insure that they are receiving the greatest payback for their new investment.

A typical club fitting session begins with a static fitting. That is, various measurements of the golfer, such as the golfer's height, the distance between the golfer's fingertip and floor, the golfer's hand size, and the like are measured and recorded. Using these measurements, the club fitter can determine a set of specifications for a custom fit golf club, as a starting point. Once the static fitting is complete, the club fitting session moves to a dynamic fitting, in which the golfer hits numerous balls so that the ball flight can be observed and the specifications of the custom-fit golf club can be refined. Typically, the golfer will hit many variations of the same club. For instance, a well-equipped fitting center might have dozens of a particular club, say a 6-iron. Each of the 6-irons will be different from the next in some way, such as lie angle, shaft flex, shaft length, and the like. The main purpose is to find the best combination of shaft, lie, grip, and swing weight that produces the best ball flight for that particular golfer.

During the dynamic fitting process, one specification that is checked and refined is the lie angle of the golf club. To determine the proper lie angle, the golfer is asked to hit several balls of a hard surface, such as a lie board. By making contact with the lie board, an impact mark will be left on the sole of the golf club, which helps determine the proper lie angle. For example, if the impact mark is near the center of the sole as measured from the heel to the toe, the lie angle is correct for that particular golfer. However, if the impact mark is toward the toe of the golf club, this indicates that the lie angle is too flat for the particular golfer. Similarly, if the impact mark is toward the heel of the golf club, the lie angle is too upright for the particular golfer. By observing where the impact marks on the sole of the golf club occur, the club fitter can determine the optimal lie angle of the golf club for that golfer.

However, determining the proper lie angle required that the club fitter make an intelligent guess as to how far the impact mark was from the center of the sole of the golf club and therefore the approximate lie angle. Once the approximate lie angle is determined, the golfer must hit several more balls with a golf club with a modified lie angle. This process is repeated until the proper lie angle is determined. To reduce the "guesswork" of the club fitter for selecting the proper lie angle, trial golf clubs used for club fitting may contain graduated markings along the sole that run perpendicular to the face of the golf club. Each graduated marking corresponds to a particular incremental change in the lie angle referenced from the center of the sole. Therefore, the club fitter can easily tell the proper lie angle for a particular golfer by observing at which graduated mark the impact mark appears, thereby eliminating any guesswork from determining the proper lie angle.

Another specification that is refined during the dynamic club fitting session is the loft angle of the golf club. Normally, this characteristic is determined using subjective criteria. In a typically club fitting session, the golfer will hit several shots with a golf club having a known loft angle. The club fitter observes the flight path of the golf ball and determines whether in his or her judgment, the flight of the ball is too high or too low. If the club fitter believes that the ball flight is too high, he or she will have the golfer hit several more shots with a golf club that has a stronger (less) loft. Conversely, if the club fitter believes that the ball flight is too low, he or she will have the golfer hit several more shots with a golf club that has a weaker (more) loft. This process continues until, in the view of the club fitter, that the golfer has achieved the proper ball flight.

Unfortunately, this approach to determining the proper loft angle for a particular golfer is subjective, inaccurate, and can lead to wide variances in the recommended loft angle based on the perception of the particular club fitting professional. One method to solve these problems is to use a launch monitor system. This system includes a device that is placed relatively close to the ball and measures the angle at which the ball leaves the face of the golf club, known as the launch angle, the initial velocity, and spin rate of the golf ball. The device then calculates the flight path of the golf ball and the total distance that the ball will carry. The system can also calculate the optimal golf ball trajectory based on the initial velocity and spin rate for a particular golfer. Although these devices are accurate, they typically require external hardware, such as a laptop computer running proprietary software to calculate the optimal loft angle. Thus, these launch monitor systems tend to be bulky and expensive which makes them difficult to transport and greatly increases the cost of the club fitting session. Additionally, due to the cost and complexity of the system, they are usually only used for determining the optimal loft angle for a driver.

Therefore, there is a continuing need for a simple and accurate method to determine the optimal loft angle for any golf club. In particular, there is a need for a trial golf club that is easily transported and cost efficient to for use with a custom club fitting system to determine the optimal loft angle for any golf club.

SUMMARY OF THE INVENTION

The invention is directed toward a trial golf club head that is used to determine the optimal loft angle for any golf club, and in particular a hybrid-type golf club. Generally described, the invention includes a trial golf club head having a face portion, a leading edge portion, a toe portion, a heel portion, a back portion having a trailing edge portion, and a sole portion. The sole portion contains a number of graduated indicia, which are substantially parallel to one another and extend from the toe portion to the heel portion. The graduated indicia are typically a series of solid lines that extend along the sole portion from the toe portion to the heel portion. The distance between successive graduated indicia is constant and corresponds to a predetermined incremental loft angle. In one exemplary embodiment, the distance between the graduated indicia is approximately 3.75 centimeters (cm), which corresponds to an incremental loft angle of approximately 3 degrees. The sole portion preferably has a radius of curvature greater than approximately 60 millimeters (mm) and more preferably of approximately 71.67 mm, which extends from the leading edge of the face portion to the trailing edge of the back portion.

More particularly described, the invention describes a trial golf club for determining the optimal loft angle of any golf club for a particular golfer. The trial golf club includes a shaft having a first end and a second end, a grip attached to the first end, and a trial golf club head attached to the second end. The trial golf club head includes a face portion with a leading edge portion, a toe portion, a heel portion, a back portion that contains a trailing edge portion; and a sole portion. The sole portion contains a plurality of graduated indicia, wherein each of the graduated indicia is substantially parallel to one another and extends substantially between the toe portion and the heel portion. The distance between each adjacent indicium is constant and corresponds to a predefined incremental loft angle. In one exemplary embodiment, the distance between each adjacent indicium is approximately 3.75 mm, which corresponds to a loft angle of approximately 3 degrees.

The invention also describes a method for determining how to properly fit a golf club for a golfer using a trial golf club. The trial golf club contains a golf club head having a predetermined loft angle and comprising a sole portion that has a series of graduated indicia extending between the heel portion and the sole portion. The method includes first having the golfer swing the trial golf club so that the golf club head contact a golf ball placed on the ground so that at least a portion of the sole portion impacts the ground and leaves an impact mark on the sole portion. Next, the indicia located nearest the impact mark are determined and the optimal loft angle for the individual golfer is determined based on the graduated indicia closets to the impact mark.

The optimal loft angle for the individual golfer is determined by calculating the number of indicia located between a central location on the sole portion between the leading edge and the trailing edge and the indicia determined to be closest to the point of impact with the ground. The calculated number of indicia is then multiplied by the predetermined incremental degrees of loft to determine the total incremental amount of loft to modify the loft angle of the golf club. Next, the total incremental loft is added to the total loft of the trial golf club if the point of impact is located between the leading edge of the club and the central location or the total incremental loft is subtracted from the total loft of the trial golf club if the point of impact is located between the trailing edge of the golf club and the central location of the sole portion.

The various aspects of the present invention may be more clearly understood and appreciated from a review of the following detailed description of the disclosed embodiments and by reference to the appended drawings and claims.

DETAILED DESCRIPTION OF THE EMBODIMENTS

Figure 1A:
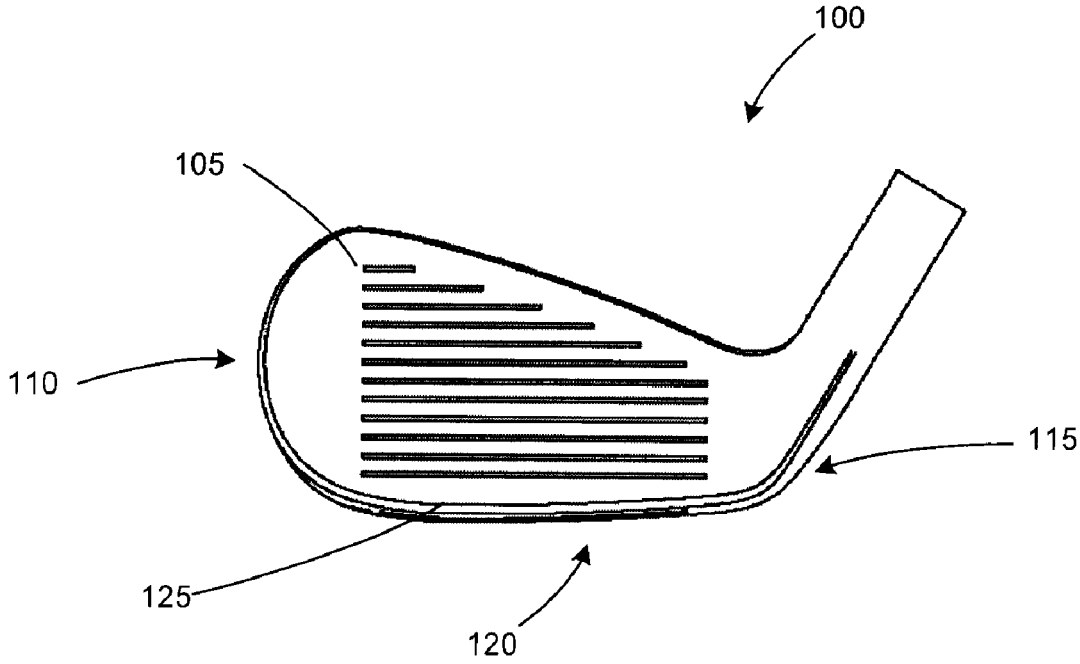
FIG. 1A is an illustration of face portion of a trial golf club for determining the optimal loft angle in accordance with some embodiments of the present invention.
Figure 1B:
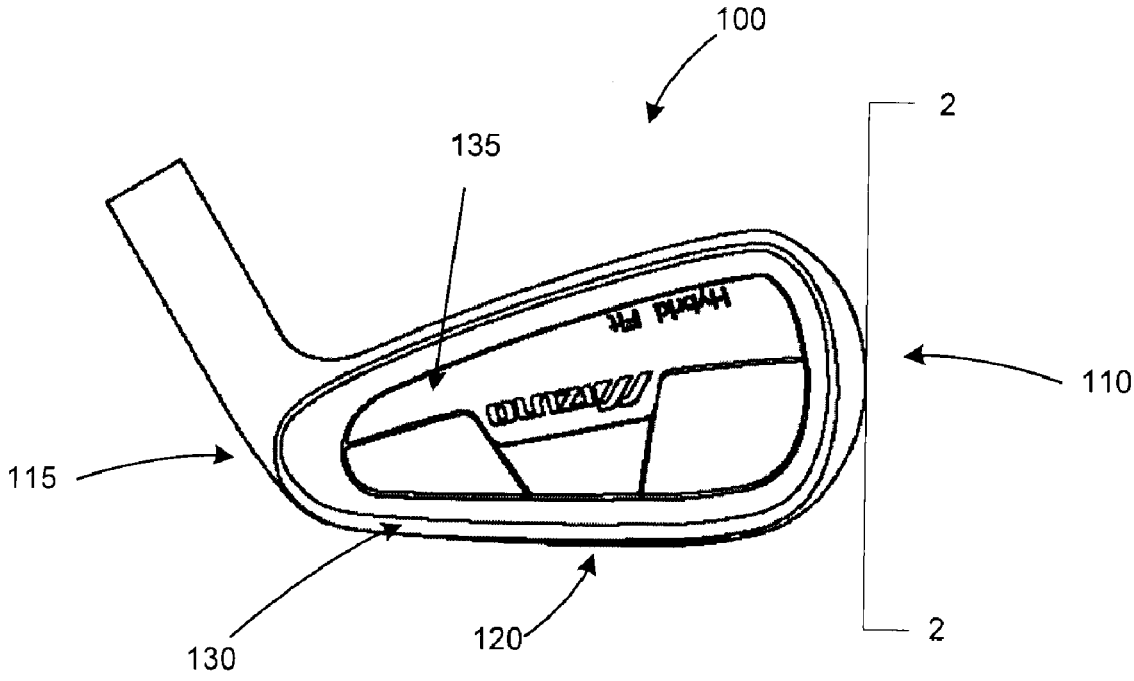
FIG. 1B is an illustration of a back portion of a trail golf club for determining the optimal loft angle of a golf club in accordance with some embodiments of the present invention.
Figure 1C:
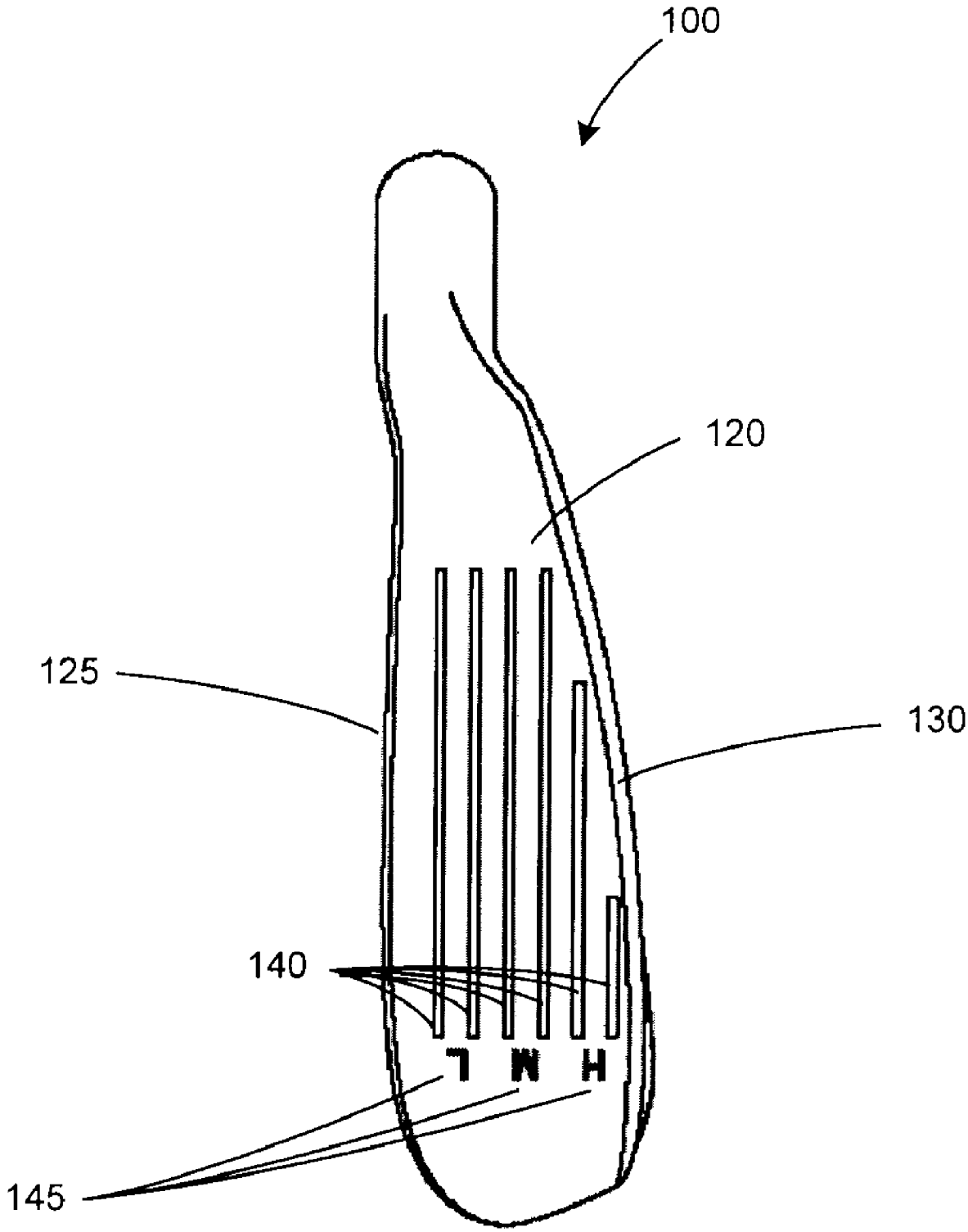
FIG. 1C is an illustration of a sole portion of a trial golf club for determining the optimal loft angle of a golf club in accordance with some embodiments of the present invention.

Turning now to the figures, in which like numerals refer to like elements through the several figures, FIG. 1A, FIG. 1B, and FIG. 1C, collectively known as FIG. 1, illustrate a trial golf club head 100 for determining the optimal loft of a golf club for use with a custom golf club fitting system. In one embodiment, the trial golf club head 100 is used to determine the loft angle of a hybrid-type or utility-type golf clubs. Normally the hybrid-type golf clubs are meant to replace the long irons, such as the 2-iron, 3-iron, or 4-iron, which are difficult for the average player to hit properly. Characteristically, the hybrid-type golf clubs have loft angles that vary between approximately 16 degrees and 25 degrees and have an incremental change in loft between successive clubs of approximately three degrees. Although the present invention is described as being used to determine the optimal loft angle for hybrid-type golf clubs, those skilled in the art will appreciate that the trial golf club 100 may be used for determining the optimal loft angle of an iron golf club, a wedge type golf club, a fairway metal golf club, or any other type of golf club without departing from the scope of the invention.

FIG. 1A is an illustration of the front view of the trial golf club head 100. The trial golf club head 100 contains a face portion 105 for striking a golf ball, a toe portion 110, a heel portion 115, a sole portion 120, and a leading edge 125 that separates the face portion 105 from the sole portion 120. FIG. 1B illustrates the back view of the trial golf club head 100. The back side contains a back portion 135 and a trailing edge portion 130, which separates the back portion 135 from the sole portion 120.

FIG. 1C illustrates a view of the sole portion 120 of the trial golf club head 100. The sole portion 120 contains a number of graduated indicia 140 that extend between the toe portion 110 and the heel portion 115. The graduated indicia 140 extend substantially between the heel portion 115 and the toe portion 110 and are arranged so that the distance between any two adjacent graduated indicia 140 corresponds to a predetermined incremental loft angle. In an exemplary embodiment, the graduated indicia 140 are a series of equally-spaced solid score lines. Those skilled in the art will appreciate that the graduated indicia 140 may be formed from other indicia, such as dashed score lines, dotted lines, and such, without departing from the scope of the invention.

The distance between adjacent indicia 140 is constant, which means that the corresponding loft angle between successive graduated indicia 140 is also constant. For example, in an exemplary embodiment, the distance between the graduated indicia 140 is between approximately 3 and 5 millimeters and more particularly about 3.75 mm. This corresponds to an incremental loft angle of between approximately 1 degree to approximately 4 degrees, and more particularly 3 degrees, which is the incremental change between loft angles available for hybrid-type golf clubs.

Figure 2:
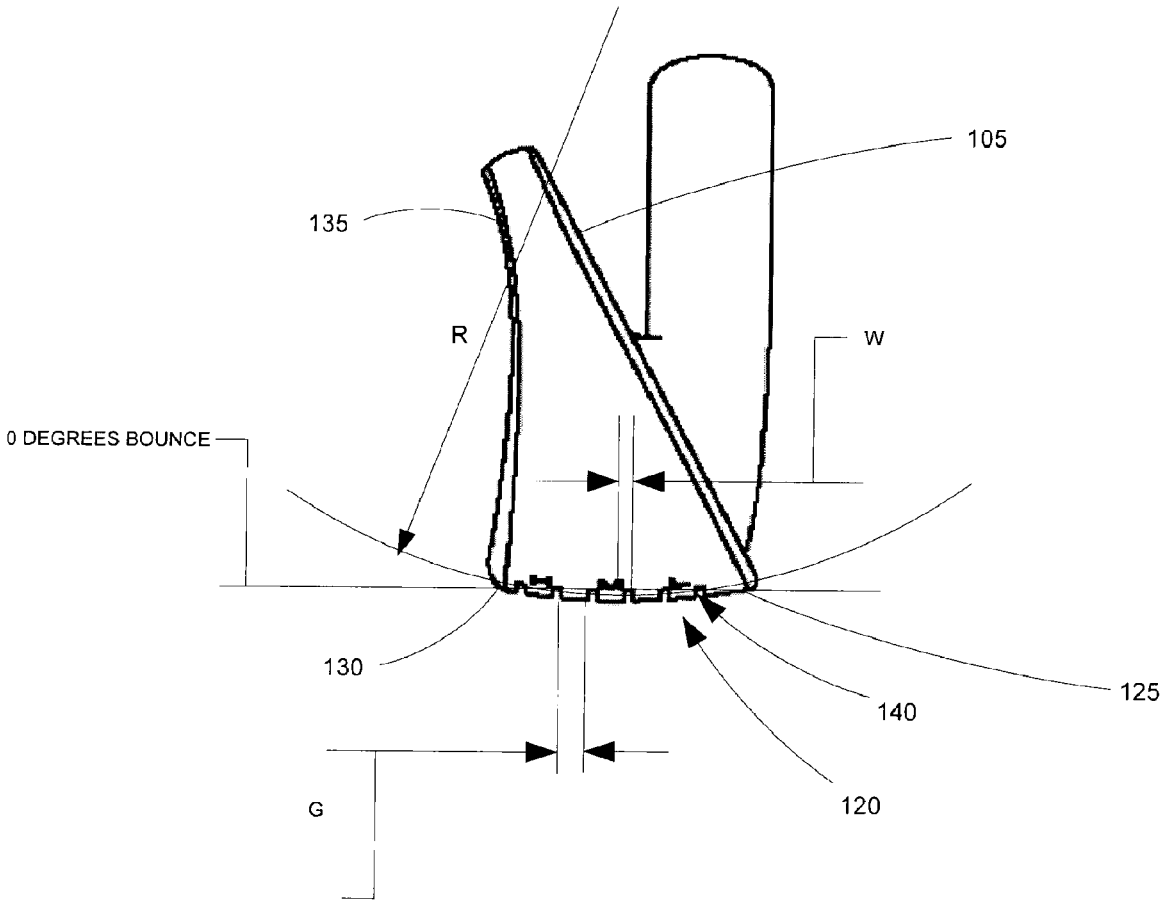
FIG. 2 is an illustration of a cross-sectional view taken along the 2-2 line of FIG. 1B of a trial golf club for determining the optimal loft angle of a golf club in accordance with some embodiments of the present invention.

FIG. 2 illustrates a cross-sectional view of the trial golf club head 100 taken along the 2-2 line in FIG. 1B. As shown by the figure, the sole portion 120 of the trial golf club head 100 is cambered, or has a radius of curvature, R, from the face portion 105 to the back portion 135. The radius of curvature of the sole portion 120 is greater than approximately 60 millimeters (mm). In one exemplary embodiment, the radius of curvature of the sole portion 140 from the face portion 105 to the back portion 135 is approximate 71.67 mm. Having a radius of approximately 71.67 mm allows the sole portion 120 to have just enough camber to allow the club to skim along the hitting surface without digging too deeply into the hitting surface, while still allowing the sole portion 120 to record the impact area where the sole portion 120 contacted the ground.

Each of the graduated indicia 140 has a given width, W, in the range of approximately 0.1-1.0 mm. In one exemplary embodiment, the width of the score lines 140 is approximately 0.5 mm. The distance, D, between the center of each graduated indicia 140 is determined by the first calculating the circumference, C, of a circle with a radius of approximately 71.67 mm using the formula:

$$C=2\pi R$$

Substituting the value of 71.67 mm as the value of the radius of curvature, R, yields:

$$C=2\pi(71.67\text{ mm})$$

$$C=450.50\text{ mm}$$

The distance to travel around an arc, D, three degrees of this circle is equal to three times the circumference, C, of the circle divided by 360 degrees, as given by the formula:

$$D=3C/360$$

Substituting the value of the circumference into the equation, yields $$D=3(450.50\text{ mm})/360$$

$$D=3.75\text{ mm}$$

Therefore the distance between the centers of any two adjacent graduated indicia 140 is 3.75 mm. The gap, G, between two adjacent indicia 140, is determined from the formula:

$$G=D-(2*(W/2))$$

where W is the width of each indicia. Substituting the values of the distance, D, and the width of the indicia, W, into the above equation provides:

$$G=3.75\text{ mm}-(2*(0.5\text{ mm}/2))$$

$$G=3.25\text{ mm}.$$

Although the width between adjacent indicia 140 corresponds to an incremental loft angle of 3 degrees, those skilled in the art will appreciate that the width may be set to correspond to any incremental loft angle, such as 1, degree, 2 degrees, 4 degrees, and the like, without departing from the scope of the invention.

Another feature of the trial golf club head 100 is that the sole has approximately zero degrees of bounce. Bounce is defined as the golf club's potential to repel the ground during contact and prevent the leading edge from digging into the ground. Bounce is measured in degrees of the angle from the front edge 125 to the trailing edge 130 when the golf club rests on the ground at address. A golf club with bounce is characterized by the trailing edge 130 being closer to the ground than the leading edge 125 when the club is addressed behind the ball. Utilizing a bounce of zero degrees ensures that trial golf club head 100 will be resting on the central location of the sole portion 120 when placed on the ground at address. This helps establish the center of the sole portion 120 is resting on the ground and establishes a consistent reference point for determining the optimal loft angle.

Figure 3:
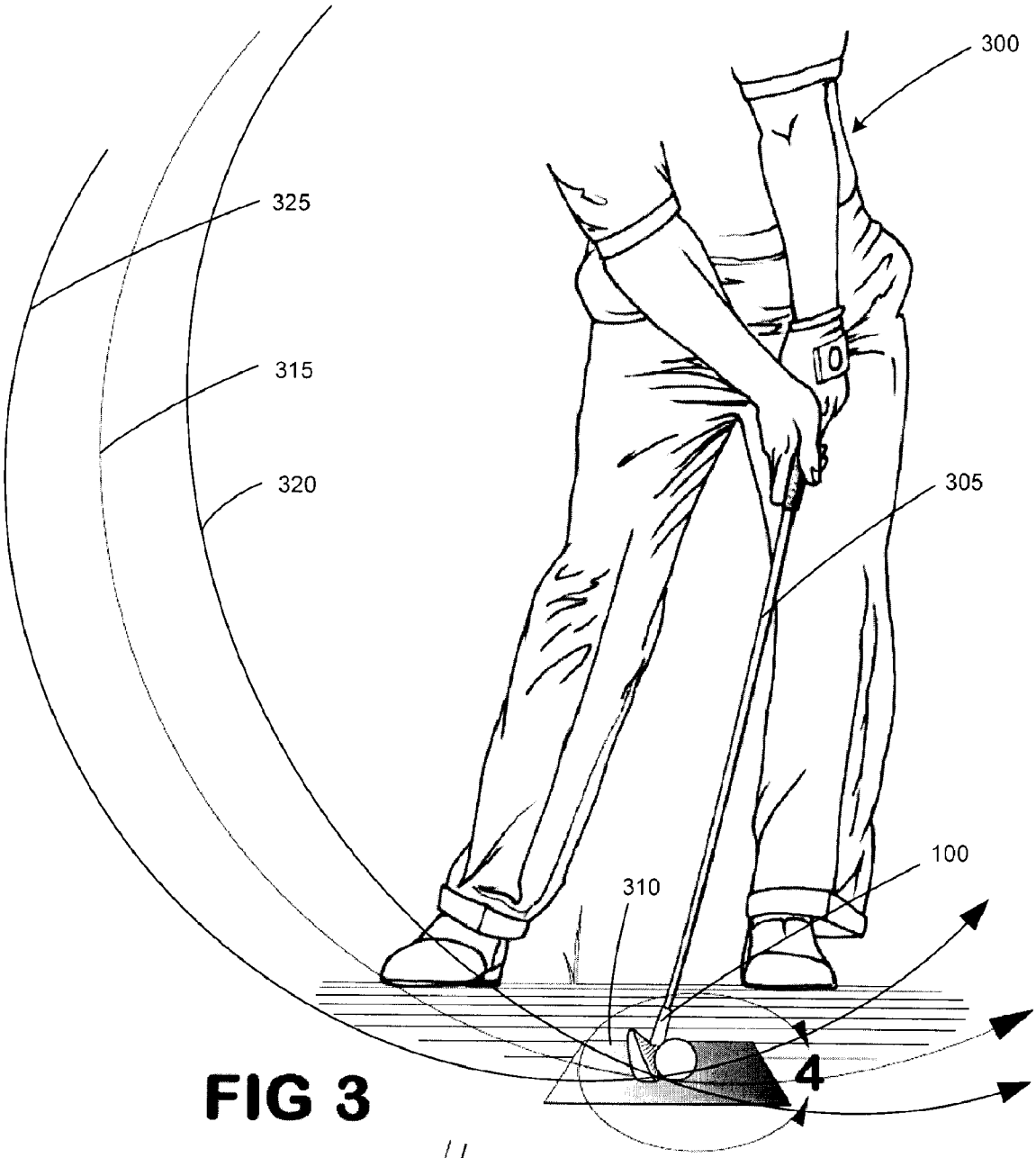
FIG. 3 is an illustration of a golfer using a trial golf club to measure the optimal loft in accordance with some embodiments of the present invention.
Figure 4:
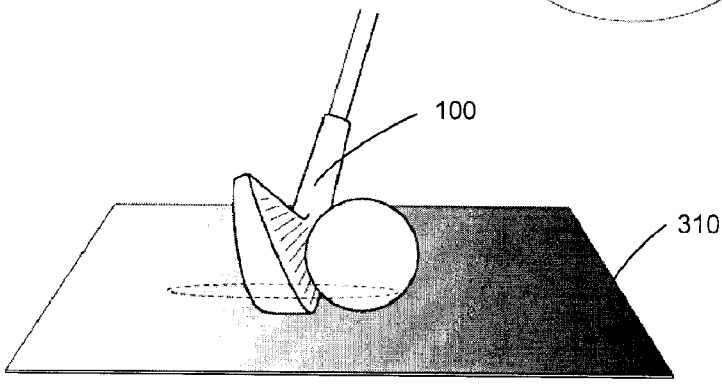
FIG. 4 is an illustration of a sole portion of a trial golf club in accordance with some embodiments of the present invention.
Figure 5:
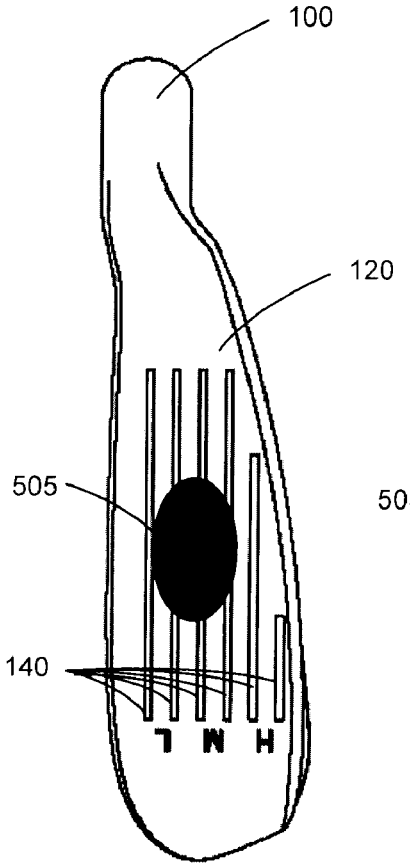
FIG. 5 is an illustration of a sole portion of a trial golf club containing an impact mark illustrating an optimal loft angle of a golf club in accordance with some embodiments of the present invention.

FIG. 3 is a diagram of a golfer 300 using a trial golf club 305 with the trial golf club head 100 to determine the optimal loft angle for a golf club, such as a hybrid-type golf club. During a club fitting session, the golfer 300 will typically hit several golf balls off of a lie board 310, or other hard surface using the trial golf club 300. When the trial golf club head 100 makes contact with the lie board 310, an impact mark is left on the sole 120 of the golf club head 100 indicating the point of the sole 120 that makes contact with the ground. The impact mark allows the club fitter to determine whether the loft angle is correct, as explained below. If the golfer 300 swings the trial golf club 300 on the correct swing path 315, the trial golf club head 100 will make contact with the lie board 310 so that the sole portion 120 is parallel to the lie board 310 at the point the trial golf club head 100 makes contact with the ball, as shown in FIG. 4. The lie board 310 will leave an impact mark 505 on the central portion of the sole portion 120, as shown in FIG. 5.

Figure 6:
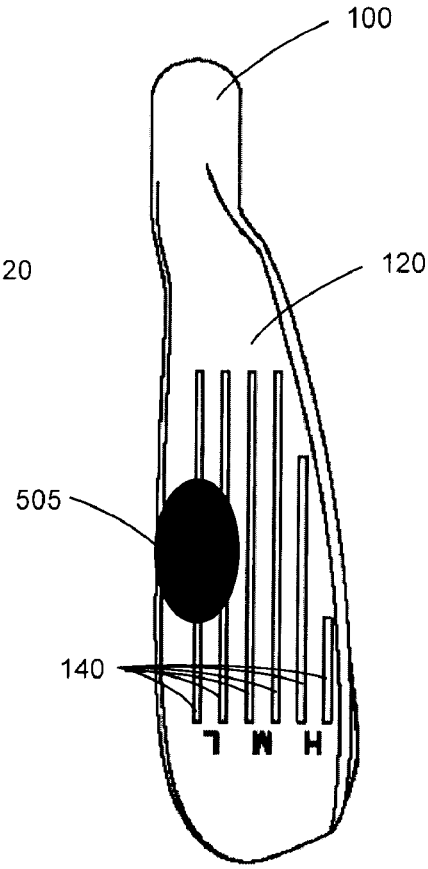
FIG. 6 is an illustration of a sole portion of a trial golf club containing an impact mark illustrating a loft angle that is too strong of a golf club in accordance with some embodiments of the present invention.

However, if the golfer 300 swings the trial golf club on a steeper swing angle 320, the trial golf club head 100 will be moving at a steeper downward angle relative to the lie board 310, which will de-loft the trial golf club 100. The de-lofting of the trial golf club 300 causes the sole portion 120 to be angled relative to the lie board 310 at the point of impact, such that the leading edge 125 will be closer to the lie board 310 than the trailing edge 130. This orientation of the trial golf club head 100 causes the impact mark 505 to be located between the leading edge 125 and the central portion of the sole 120, as illustrated in FIG. 6. The position of the mark between the leading edge 125 and the central portion of the sole 120 indicates that the golfer 300 has a steep swing angle, which results in a lower ball trajectory and reduced overall distance. By observing at which graduated indicia 140 the impact mark 505 is centered on or nearest to, the number of degrees the club has been de-lofted can be determined. For example, if the distance between each graduated indicia 140 corresponds to an increment of 3 degrees, and the impact mark 505 is centered on the second graduated indicia, then the club has been de-lofted by 6 degrees. The club fitter can then weaken, or add 6 degrees of loft to the golfer's club so that the golf ball achieves the proper trajectory and maximum carry for the particular golfer 300.

Figure 7:
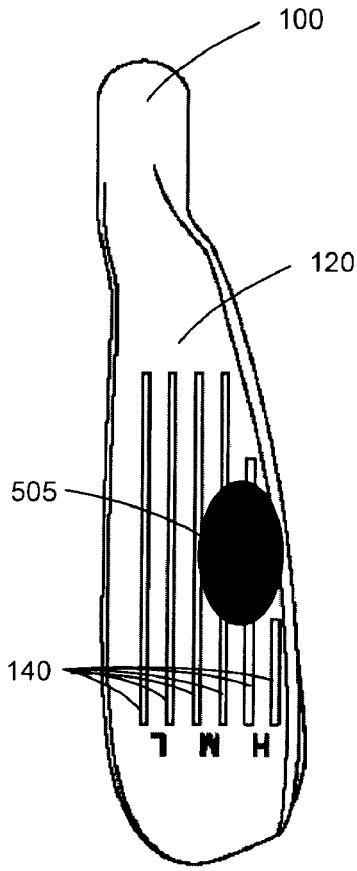
FIG. 7 is an illustration of a sole portion of a trial golf club containing an impact mark on the sole portion that indicates that the loft angle of a golf club is too weak in accordance with some embodiments of the present invention.

Conversely, if the golfer 300 has a shallow or flat swing path 325, the golf club head 100 will be moving at a shallower downward angle relative to the conventional swing path 315. The shallower swing path 325 means that the bottom of the swing path will bottom out behind the ball, which will increase the loft the trial golf club 100. The added loft of the golf club 310 will cause the sole 120 to be angled relative to the lie board 310, such that the leading edge 125 will be farther away from the lie board 310 at the point of impact than the trailing edge 130. This orientation of the trial golf club head 100 causes the impact mark 505 to be located between the central location of the sole portion 120 and the trailing edge 135, as illustrated in FIG. 7. The position of the mark between the central portion of the sole 120 and the trailing edge 135 indicates that the golfer 300 has a shallow swing angle, which results in a higher ball trajectory and reduced distance. By observing at which graduated indicia the impact mark 505 is centered on or nearest to, the number of degrees that have been added to the club 100 by the shallow swing angle can be determined. For example, if the distance between each graduated indicia 140 corresponds to an incremental loft angle of 3 degrees, and the impact mark 505 is centered on the second graduated indicia away from the central portion of the sole 120, then the loft of the trial club must be increased by 6 degrees to allow the golfer to achieve the proper trajectory. The club fitter can then strengthen, or remove 6 degrees of loft to the golfer's custom fit club so that the golfer 300 can achieve the proper loft angle and maximum carry on his or her golf shots.

The sole portion 120 can also contain other types of indicia 145 in combination with the graduated indicia 140. For example, in an exemplary embodiment, the sole portion 120 may contain the letters "H", "M", and "L" located near the toe portion 110. The letter "H" is located near the back portion and stands for "high". It provides the club fitter with a quick reference that if the impact mark 505 appears near the trailing edge 130, the loft is too high for that particular golfer. The letter "M" corresponds to the term "middle" and serves to indicate that if the impact mark 505 appears near the central location of the sole portion, the loft angle is correct for the particular golfer. Similarly, the letter "L" corresponds to "low" and provides a quick indicator that if the impact mark 505 appears near the leading edge 125, the loft angle is too weak for the particular golfer.

Figure 8:
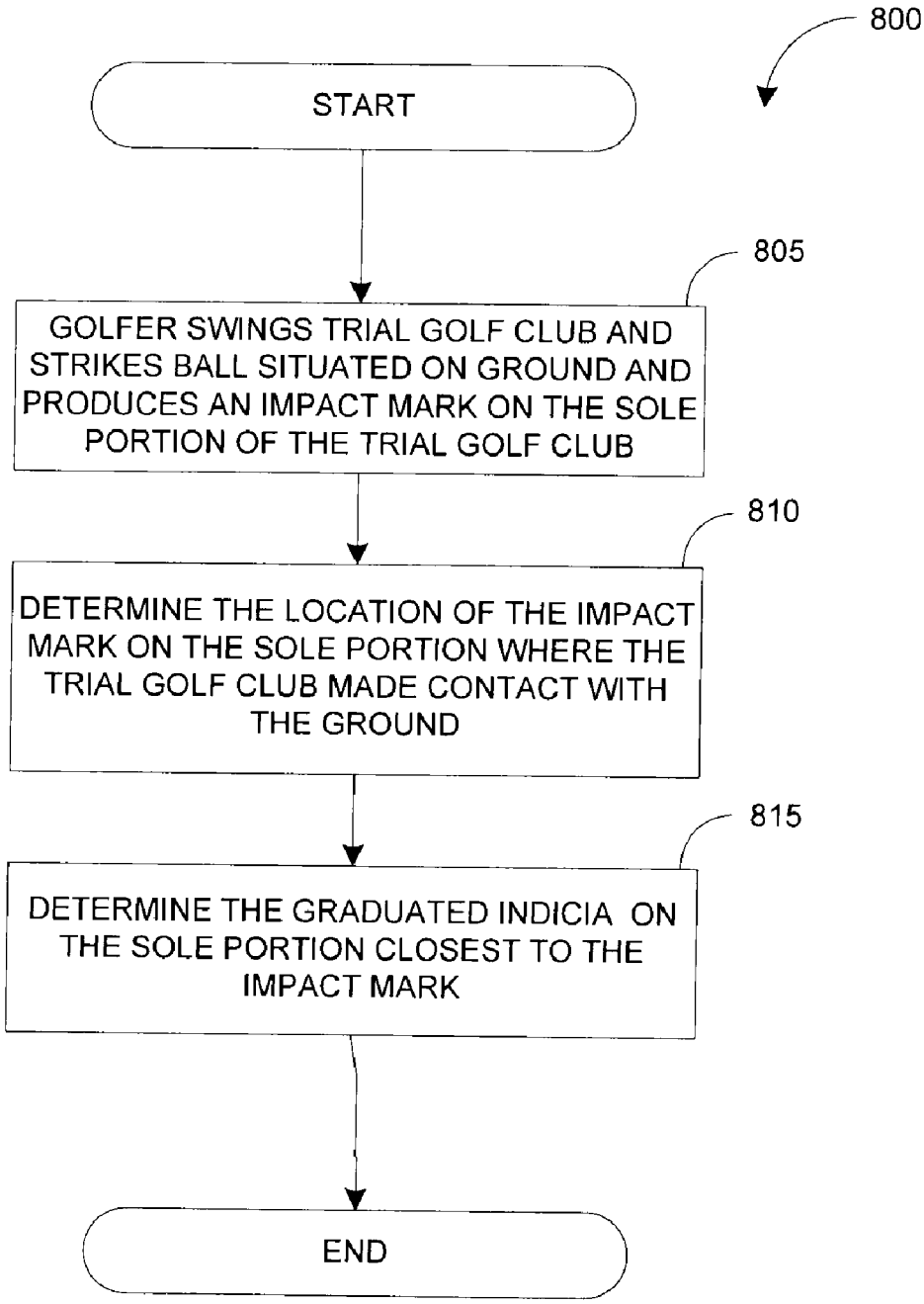
FIG. 8 is a logic flow diagram illustrating a routine for using a trial golf club for determining the optimal loft angle of golf club for a particular golfer in accordance with some embodiments of the present invention.

FIG. 8 is a logic flow diagram illustrating routine 800 for determining the optimal loft for a golf club using the trial golf club 300. Routine 800 begins at 805, in which a golfer swings the trial golf club 300 at a golf ball located on a hard surface. In an exemplary embodiment, the hard surface may be a lie board 310, which is a thin board, typically ⅛" thick, made from hard polymer material. The lie board 310 leaves a temporary mark on the sole portion 120 of the trial golf club head 100 at the point where the sole of the club impacted the lie board 310. In some instances, it may be desirable to place a piece of adhesive tape on the sole portion 120 of the golf club head 100. The masking tape will protect the sole portion 120 of the golf club head 100, while still allowing the impact mark from the lie board 310 to be seen. To further enhance the visibility of the mark left by the impact to the sole 120 with the lie board 310, special impact tape may be used in place of the adhesive tape. The impact tape, which is known in the art, changes color to show the point where the sole portion 120 of the golf club head 100 is making contact with the lie board.

At 810, the location of the impact area where the sole portion 120 made contact with the lie board 310 is determined. Typically, the point of impact is determined through visual examination of the sole portion 120 of the golf club head 100. When the sole portion 120 makes contact with the lie board 310, the lie board 310 will impart an impact mark 505 (FIG. 5) on the sole portion 120. The location of the impact mark 505 relative to the central portion of the sole portion 120 is then determined. The graduated indicia 140 that lie closest to the center of the impact mark 505 is determined and the optimal loft for the golf club for the particular golfer 300 is determined.

Figure 9:
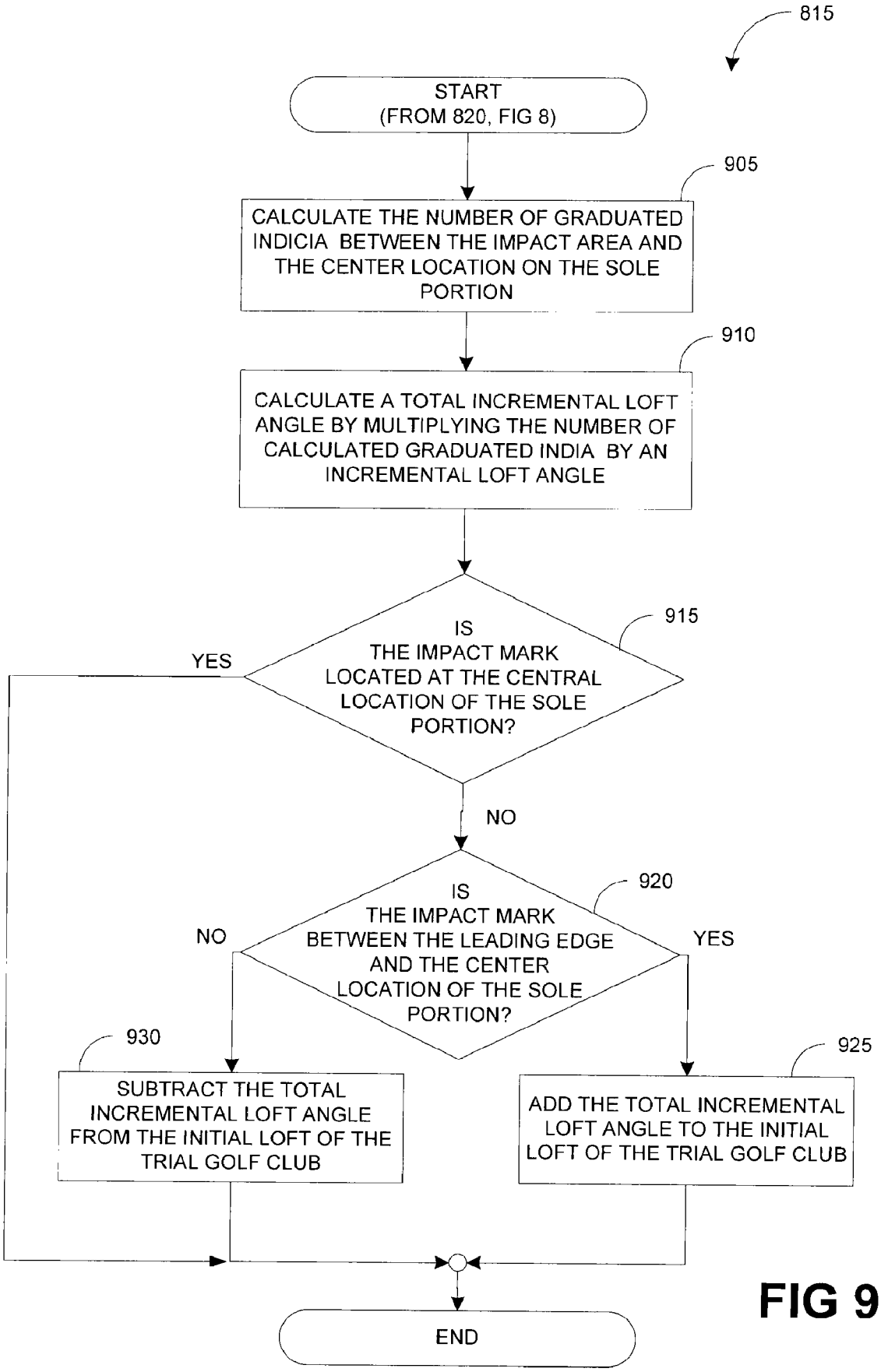
FIG. 9 is a logic flow diagram illustrating a routine for calculating the optimal loft angle for a golf club in accordance with some embodiments of the present invention.

FIG. 9 is a logic flow diagram illustrating routine 815 of FIG. 8. Routine 815 begins at 905, in which the number of graduated indicia 140 between the graduated indicia closest to the center of the impact mark 505 and the graduated indicia 140 at the central portion of the sole portion 120. At 910, the calculated number of graduated indicia 140 is multiplied by the incremental loft corresponding to the distance between two successive graduated indicia 140 to achieve the total incremental loft that has to be added or subtracted to the loft of the trial golf club. Next, at 915, the determination is made whether the impact mark 505 occurred at the central location of the sole portion 120. If the impact mark occurred at the central location of the sole portion 120, then the loft is correct for the particular golfer 300 and the "YES" branch is followed to the "END" step, as no adjustment to the loft of the golfer's clubs is necessary. However, if the impact mark 505 did not occur at the central location of the sole portion 120, then the "NO" branch is followed to 920.

At 920, the determination is made whether the impact mark 505 occurred between the leading edge 125 and the central portion of the golf club. If the determination is made that the impact mark 505 occurred between the leading edge 125 and the central location of the sole portion 120, then the "YES" branch is followed to the 925, where the calculated incremental loft is added to the initial loft of the trial golf club head 100. Routine 815 then proceeds to the "END" step. However, if the impact mark 505 is not located between the leading edge 125 and the central location of the sole portion 120, the golfer 300 has a shallow swing path and the "NO" branch is followed to 930. At 930 the loft of the trial golf club head 100 is strengthened by subtracting the total calculated incremental loft from the initial loft of the trial golf club head 100. Routine 815 then proceeds to the "END" step.

Other alternative embodiments will become apparent to those skilled in the art to which an exemplary embodiment pertains without departing from its spirit and scope. Accordingly, the scope of the present invention is defined by the appended claims rather than the foregoing description.

We claim:

1. A trial golf club head, comprising:

a face portion comprising a leading edge portion;

a toe portion;

a heel portion;

a back portion comprising a trailing edge portion; and a sole portion having a plurality of graduated loft angle indicia, wherein each of the graduated indicia are substantially parallel to one another and extend substantially from the toe portion to the heel portion and the distance between adjacent loft angle indicia corresponds to a selected degree change in loft angle;

wherein the distance between each of the plurality of graduated indicia is substantially constant;

wherein the distance between each of the graduated indicia is approximately 3.75 millimeters; and wherein the distance between the graduated indicia corresponds to approximately 3 degrees of loft.

2. The golf club head of claim 1, wherein the sole portion comprises a radius of curvature greater than approximately 60 millimeters and extending from the leading edge of the face portion to the trailing edge of the back portion.

3. The golf club head of claim 2, wherein the radius of curvature is approximately 71.67 millimeters.

4. The golf club head of claim 1, wherein the offset between the trailing edge and the leading edge relative to a ground plane is approximately zero degrees when a central portion of the sole in the front to back direction is in contact with the ground.

5. The golf club head of claim 1, wherein the indicia are lines on the surface of the sole.

6. The golf club head of claim 1, wherein the surface of the sole is substantially smooth.

7. The trial golf club of claim 1, further comprising reference indicia associating the graduated loft angle indicia with a selected degree change in loft angle.

8. A trial golf club for use with a fitting system for determining the optimal loft angle of a golf club, the trial golf club comprising:

a shaft having a first end and a second end;

a grip attached to the first end; and a golf club head attached to the second end, comprising:

a face portion, comprising a leading edge portion;

a toe portion;

a heel portion;

a back portion comprising a trailing edge portion; and a sole portion having a plurality of graduated loft angle indicia, wherein each of the graduated indicia are substantially parallel to one another and extend substantially from the toe portion to the heel portion and the distance between adjacent loft angle indicia corresponds to a selected degree change in loft angle;

wherein the distance between each of the plurality of graduated indicia is substantially constant;

wherein the distance between each of the graduated indicia is approximately 3.75 millimeters; and wherein the distance between the graduated indicia corresponds to approximately 3 degrees of loft.

9. The trial golf club of claim 8, wherein the sole portion comprises a radius of curvature greater than approximately 60 millimeters and extending from the leading edge of the face portion to the trailing edge of the back portion.

10. The trial golf club of claim 9, wherein the radius of curvature is approximately 71.67 millimeters.

11. The trial golf club of claim 8, wherein the offset between the trailing edge and the leading edge relative to a ground plane is approximately zero degrees when a central portion of the sole in the front to back direction is in contact with the ground.

* * * * *